United States Patent [19]

Compton et al.

[11] 3,965,941

[45] June 29, 1976

[54] SHUTTLE SPRING

[76] Inventors: Ralph M. Compton, 4 Briarcreek Place; Johnny W. Jenkins, Jr., 111 Sycamore Drive, both of Greenville, S.C. 29607

[22] Filed: May 8, 1975

[21] Appl. No.: 575,451

[52] U.S. Cl. ..... 139/207

[51] Int. Cl.[2] ..... D03J 5/08

[58] Field of Search..... 139/207, 206, 208, 196 R

[56] References Cited

UNITED STATES PATENTS

| | | | |
|---|---|---|---|
| 867,740 | 10/1907 | Mills | 139/207 |
| 907,476 | 12/1908 | Draper | 139/207 |
| 1,394,878 | 10/1921 | Wright | 139/207 |
| 2,785,702 | 3/1957 | Miller | 139/207 X |

*Primary Examiner*—James Kee Chi

*Attorney, Agent, or Firm*—Bailey & Dority

[57] ABSTRACT

This invention relates generally to a shuttle spring for holding a yarn filled bobbin in a loom shuttle wherein the spring has a pair of opposed jaw portions for resiliently holding the bobbin therebetween. A vertical side surface of one of the jaw portions has a greater vertical width than the vertical side surface of the opposing jaw portion to effect rotation of the bobbin, when being ejected from the shuttle by the insertion of a full bobbin, in a direction so as to ensure that an adequate transfer tail of unused yarn separates from the spent bobbin. The transfer tail of yarn trailing from the bobbin is then caught by a stripping machine which completely strips the bobbin of the unused yarn.

3 Claims, 4 Drawing Figures

SHUTTLE SPRING

BACKGROUND OF THE INVENTION

When using automatically filling replenishing shuttles such as shown in U.S. Pat. Nos. 1,574,643 and 1,812,087, on weaving looms, it is necessary to continuously replenish the shuttle automatically with a refilled bobbin. In so doing, the empty or used bobbin is pushed or ejected out of the shuttle by the insertion of the refilled bobbin. However, in ordinary practice, the ejected bobbin is not completely empty and may have from 7 to 13 yards of unused yarn left thereon. Therefore, the ejected bobbin must be completely unwound or stripped of yarn before it can be refilled with yarn. The ejected bobbin is usually delivered to an automatic yarn filling machine having a yarn stripper such as the Unifil Loom Winder, Model No. 790, made by the Leesona Corp., wherein a transfer tail of the unused yarn trailing from the ejected bobbin is caught by the stripper and the unused yarn is wound around a comb in the stripping machine. The empty bobbin is then filled or rewound with new yarn.

In many instances, however, an adequate transfer tail of yarn is not created when the used bobbin is ejected from the shuttle. As the used bobbin is ejected from the shuttle, it is caused to rotate in one direction or the other. Generally, if the bobbin rotates in a direction opposite to that in which the unused yarn is wound, the creation of an adequate transfer tail tends to be impaired, however, if the bobbin is caused to rotate in the same direction in which the unused yarn is wound, the creation and separation of an adequate transfer tail will be enhanced.

If an adequate transfer tail is not created on the ejected bobbin, the bobbin will not be unwound or stripped by the stripping machine and will have to be stripped manually by the machine attendant. Quite often an unstripped bobbin will not be ejected by the stripping machine and will be delivered back to the automatic filling machine with new yarn being wound upon the unused yarn. When this is done, a defect can occur in the fabric being woven and can cause other operational damage during the weaving process. Therefore, it is expedient to maximize the likelihood that an adequate transfer tail of unused yarn will be created on the used bobbin when ejected from the shuttle which is afforded when using a shuttle spring constructed in accordance with the present invention.

SUMMARY OF THE INVENTION

A shuttle spring for holding a bobbin in a loom shuttle is provided comprising a single piece of metal having a bent portion formed by bending the single piece of metal on itself, a pair of shank portions defined by the side of the single piece of metal on each side of the bent portion, and a pair of jaw portions having vertical sides with interior surfaces for resiliently engaging and holding the bobbin. Each of the jaw portions is connected to one of the shank portions by a side arm portion. A vertical side surface of one of the jaw portions has a greater vertical width than the vertical side surface of the opposing jaw portion whereby a bobbin ejected from the shuttle spring is caused to rotate in a direction so as to cause the unused portion of yarn wound thereupon to be unwound creating a transfer tail of yarn separated from the bobbin for transfer of the yarn to a stripping machine.

Accordingly, an important objective of the present invention is to provide a shuttle spring for holding a yarn filled bobbin in a loom shuttle which will cause an adequate transfer tail of unused yarn to separate from the bobbin when the used bobbin is ejected from the shuttle.

Another important object of the present invention is to provide a shuttle spring for holding a yarn filled bobbin in a loom shuttle wherein the spring has a pair of jaw portions for holding the bobbin therebetween and which cause the bobbin to rotate in a desired direction when being ejected from the shuttle.

The construction designed to carry out the invention will be hereinafter described, together with other features thereof.

The invention will be more readily understood from a reading of the following specification and by reference to the accompanying drawing forming a part thereof, wherein an example of the invention is shown and wherein:

DESCRIPTION OF A PREFERRED EMBODIMENT

Figure 1:
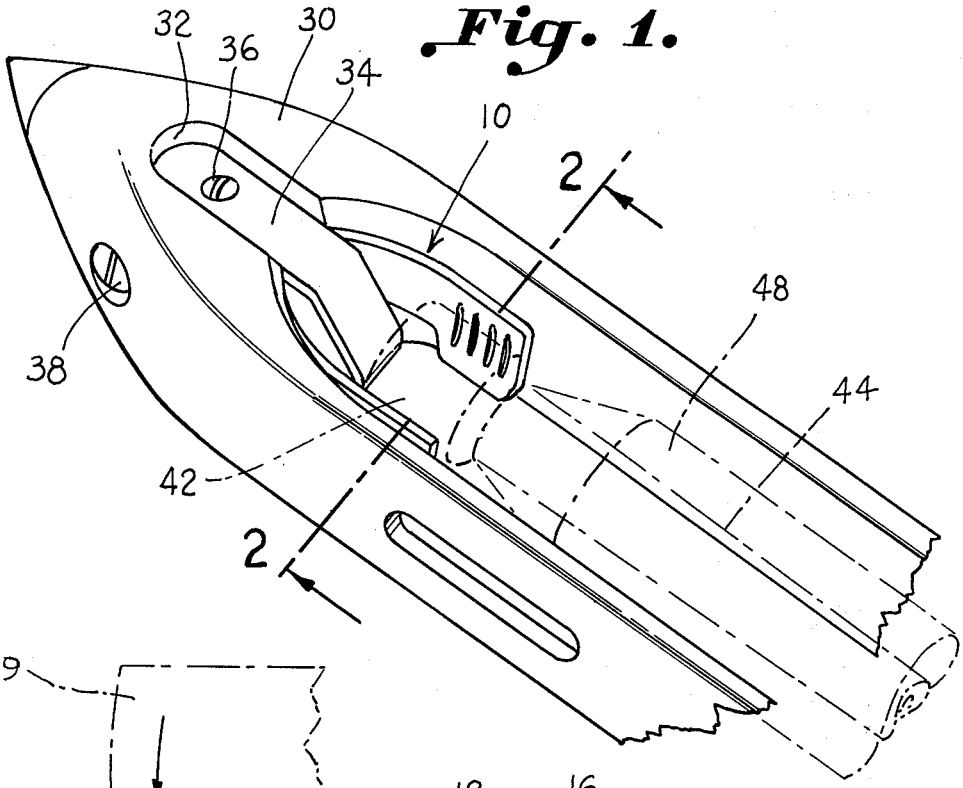
FIG. 1 is a cut-away perspective view illustrating a shuttle spring, constructed in accordance with the present invention, mounted within a loom shuttle for resiliently gripping the head of a bobbin.

The apparatus of the present invention may be utilized to hold a yarn filled bobbin in a conventional shuttle used on a loom and may be utilized with particular advantage for holding a bobbin in a automatically filling replenishing shuttle when used on a loom having an automatically-operated bobbin winding and stripping means such as shown in U.S. Pat. No. 2,638,936. In such a machine, the spent bobbins are ejected from the shuttle and are automatically stripped of any unused yarn and rewound for storage in a bobbin magazine to be continuously supplied for transfer to the shuttles of the loom.

More specifically, such machines transfer a newly filled bobbin to the shuttle by forcing the spent bobbin outwardly through the bottom of the shuttle. As the ejected bobbin leaves the shuttle it descends through a chute into a stripping machine for removing the unused yarn remaining thereon. The completely empty bobbin is then delivered into a tray at the bottom of the stripper to be conveyed by a conveyor belt back to the automatic winding machine for replenishing the bobbin with a new filling of yarn. Thereafter, the newly filled bobbins are stored in a magazine and resupplied to the shuttles as needed. Thus, the machine operates in a complete cycle in automtically replenishing the shuttle with a yarn filled bobbin.

The apparatus of the present invention provides a shuttle spring for holding a bobbin in a loom shuttle which improves the efficiency of the yarn stripping process. The shuttle spring, designated generally as 10 in the drawing, comprises a single piece of metal having a bent portion 12 formed by bending the single piece of metal upon itself. A pair of shank portions 14 and 16 are defined by the sides of the metal piece on each side of the bent portion. The shuttle spring further comprises a pair of spaced-apart jaw portions 18 and 20 having vertical sides with opposing surfaces 22 and 24, respectively, for resiliently engaging and holding the bobbin therebetween. The jaw portion 18 is connected to shank portion 14 by a side arm portion 26 and jaw portion 20 is connected to shank portion 16 by a side arm portion 28.

The jaw portion 20 has an a protuberant portion 25 extending downwardly therefrom providing vertical side surface 24 with an extended width and a greater vertical width than the opposing vertical side surface 22 of jaw portion 18. This causes the ejected bobbin sliding across the opposing surfaces to twist or rotate in a counter-clockwise direction as can best be seen in FIG. 2. In one embodiment, the approximate vertical width of side surface 24 is 13/16 of an inch and of side surface 20 is 10/16 of an inch. Therefore, the extended portion 25 has an extended width of approximately 3/16 of an inch.

The shuttle spring 10 is preferably formed from a single piece of suitable metal, such as steel, and may be formed in any conventional manner as by stamping. The extended portion 25 may also be stamped out in the same operation or may be formed in a separate operation in any suitable manner, such as by machining. Once the single piece of metal is stamped out, it may then be bent itself to form the shuttle spring 10.

In assembling the shuttle spring 10 with the shuttle 30, the shank portion of the shuttle spring is received within a standard cutout shank receiving portion 32 of the shuttle. With the shuttle spring in place, a bobbin guide 34 is placed over the top of the shank portions 14 and 16 of the shuttle spring and is fastened to the shuttle by means of screw 36. The shank portions 14 and 16 have transverse openings 14*a* and 16*a*, respectively, through which passes a transverse bolt 38 for securing the shuttle spring within the shank receiving portion of the shuttle. Thus, the parts are assembled in a rigid and permanent manner together as a unit.

The shuttle spring is provided with a plurality of holding grooves 40 in each of the opposing side surfaces 24 and 22 for receiving metal rings 46 carried on a butt or head portion 43 of the bobbin for holding the bobbin 42 in the jaw portions. The shuttle spring may be used to hold a bobbin made of wood or other material of a conventional shape with the enlarged butt 43 at one end and a barrel 44 tapering towards its opposite tip end. The yarn 48 is wound on the barrel portion 44 in a counter-clockwise direction in a conventional manner.

Figure 2:
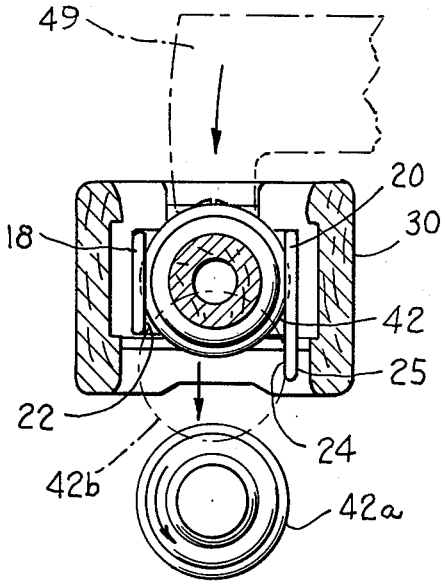
FIG. 2 is a sectional view taken along line 2—2 of FIG. 1 illustrating the ejection of a spent bobbin from a shuttle spring constructed in accordance with the present invention.
Figure 4:
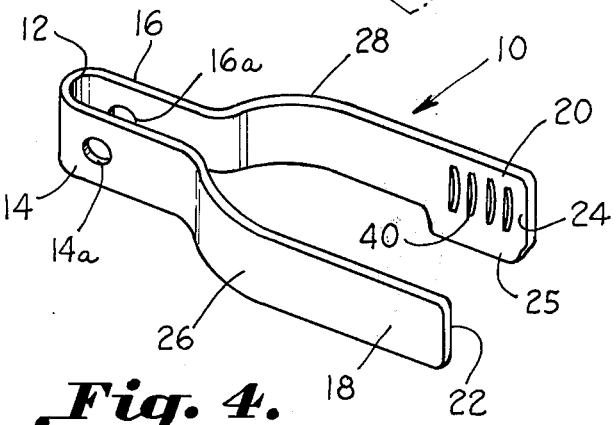
Figure 3:
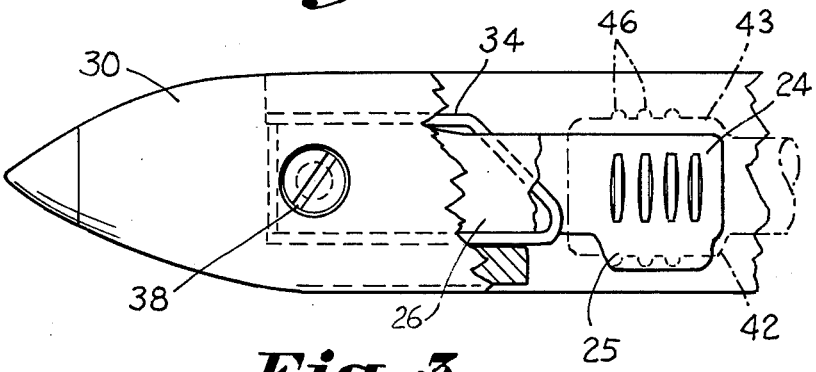
FIG. 3 is a side elevational view illustrating a shuttle spring, constructed in accordance with the present invention, mounted within a loom shuttle partially cut away and, FIG. 4 is a perspective view of a shuttle spring, itself, constructed in accordance with the present invention.

The operation of ejecting a spent or empty bobbin 42*a* from the shuttle spring 10 and thus the shuttle 30 is best illustrated in FIG. 2 wherein a bobbin 42 newly filled or replenished with yarn is forced into the shuttle by a transfer hammer arm 49 in a conventional manner as is disclosed, for example, in U.S. Pat. No. 2,766,779. Prior to ejection, the yarn on the spent bobbin is cut releasing the yarn from the fabric being woven. As the spent bobbin leaves the shuttle, as it is shown in the position of 42*b*, the shuttle spring 10, with the vertical side surface 24 having a greater vertical width than the opposing side surface 22, will impart a counter-clockwise twist or rotation to the bobbin.

Thereafter, the spent bobbin 42*a* will descend through the chute of the stripper machine, and as it rotates, a transfer tail of the unused yarn will be effectively created and separate from the bobbin. The transfer tail will then be sufficient to be caught in the stripping machine which will completely unwind and strip the bobbin so that it may be delivered to the automatic winding machine to be rewound completely with new yarn.

The chute of a conventional stripping machine, such as the Unifil Loom Winder, Model 790, manufactured by the Leesona Corporation, contains a downwardly inclined wear plate protruding from a wall of the chute into the chute interior having a rubber insert carried thereon. The wear plate and insert are oriented such that the descending bobbin head 42*a* will strike the inclined surface of the wear plate insert to impart a counter-clockwise twist to the bobbin as viewed from the rear of the bobbin in a conventional manner. A bobbin ejected from a conventional shuttle spring may be rotating in a clockwise direction when it strikes the wear plate insert and hence its rotation will be retarded. However, a bobbin ejected from a shuttle spring constructed in accordance with the present invention will be rotating in a counter-clockwise direction and its rotation will be increased upon striking the wear plate insert.

Thus, the creation and separation of a sufficient transfer tail is ensured as the bobbin falls through the stripper which will be caught by a rotating brush for transfer to an unwinding comb in a conventional manner. The motion of the bobbin will tend to unravel more yarn as it descends past the brush thus ensuring the transfer tail is not pulled away from the catching brush.

A shuttle spring constructed in accordance with the present invention virtually eliminates the problem of unstripped bobbins. Savings in labor is afforded since a machine attendant need not spend time in manually stripping bobbins whose tails are not caught in the stripping machine. In addition, the problem of having an unstripped bobbin accidently delivered to the automatic winding means is reduced which alleviates defective fabric caused by having new yarn wound upon an unstripped bobbin.

While a preferred embodiment of the invention has been described using specific terms, such description is for illustrative purposes only, and it is to be understood that changes and variations may be made without departing from the spirit or scope of the following claims.

What is claimed is:

1. A shuttle spring for holding a bobbin having yarn wound thereon in a loom shuttle comprising:

a single piece of metal having a bent portion formed by bending said single piece of metal upon itself, a pair of shank portions defined by the sides of said single piece of metal on each side of said bent portion, a pair of spaced-apart jaw portions having opposed vertical side surfaces for resiliently engaging and holding said bobbin therebetween, a side arm portion connecting, respectively, each one of said jaw portions to one of said shank portions, and one of said vertical side surfaces having a greater vertical width than the opposing vertical side surface of said other jaw portion so as to cause said bobbin to rotate in a direction causing the yarn wound thereon to create an effective transfer tail when the bobbin is forced outwardly from said jaw portions of said shuttle spring.

2. The device of claim 1 wherein said vertical side surface having a greater vertical width includes a protubertant portion extending downwardly from a bottom edge of said vertical side surface providing an extended surface across which said bobbin passes when being forced outwardly from said jaw portions.

3. A bobbin holding device for holding a bobbin having yarn wound thereon in a loom shuttle comprising:

a pair of spaced-apart jaw members having opposed vertical side surfaces for resiliently engaging and holding said bobbin therebetween, means resiliently holding said jaw members in said opposed, spaced-apart relationship, and one of said vertical side surfaces having a greater vertical width than the opposing vertical side surface of said other jaw portion, said one of said vertical side surfaces extending vertically below a lower edge of said opposing vertical side surface so as to impart a rotation to said bobbin to create an effective transfer tail of unused yarn when said bobbin is ejected from said jaw portion.

* * * * *